US007487903B2

(12) United States Patent
Billen

(10) Patent No.: US 7,487,903 B2
(45) Date of Patent: Feb. 10, 2009

(54) VEHICLE REPLICA CARTON AND METHOD OF FORMING THE SAME

(75) Inventor: William D. Billen, Topeka, KS (US)

(73) Assignee: Kid Stuff Marketing, Inc., Topeka, KS (US)

( * ) Notice: Subject to any disclaimer, the term of this patent is extended or adjusted under 35 U.S.C. 154(b) by 0 days.

(21) Appl. No.: 11/788,195

(22) Filed: Apr. 19, 2007

(65) Prior Publication Data

US 2008/0257941 A1 Oct. 23, 2008

(51) Int. Cl.
*B65D 5/42* (2006.01)
*A63H 33/16* (2006.01)

(52) U.S. Cl. ..... 229/116.4; 206/457; 446/488

(58) Field of Classification Search ..... 229/116.4, 229/238, 904; 446/488, 75, 76, 80, 487; 206/457
See application file for complete search history.

(56) References Cited

U.S. PATENT DOCUMENTS 1,547,176 A * 7/1925 Lazaron ..... 229/116.4
1,553,793 A * 9/1925 Rozowsky ..... 229/116.4
2,823,844 A * 2/1958 Frankenstein ..... 229/116.4
4,055,250 A * 10/1977 Mayhew ..... 206/457
4,643,349 A * 2/1987 Sheffer ..... 229/116.4
4,646,959 A * 3/1987 Sheffer ..... 229/116.4
4,661,082 A * 4/1987 Sheffer ..... 446/488
4,804,133 A * 2/1989 Kiyokane ..... 229/116.4
5,454,508 A 10/1995 Billen
5,622,256 A * 4/1997 Tesar ..... 206/457
D547,396 S * 7/2007 Yaguchi ..... D21/552

* cited by examiner

*Primary Examiner*—Gary E Elkins
(74) *Attorney, Agent, or Firm*—Chase Law Firm, L.C.

(57) ABSTRACT

A method of forming a container for food or other items having a model vehicle configuration is provided that accurately depicts the contours and dimensions of the vehicle to enhance its appeal. An elongated, cardboard-like sheet is presented that is die cut to fold into a three dimensional model of the vehicle. The sheet's first end is folded along a first pair of transverse fold lines and secured in a position to present an open cabin, rear deck and tail of the vehicle, whereby the open cabin may provide the container for food and other items. The sheet's central portion is folded upwardly along a pair of longitudinal fold lines to present the sides of the vehicle, and the second end portion is folded along a second pair of transverse fold lines and secured in position to present the hood and front windshield of the vehicle.

7 Claims, 5 Drawing Sheets

VEHICLE REPLICA CARTON AND METHOD OF FORMING THE SAME

The present invention relates to cartons or trays which are formed from a sheet of cardboard-like material and have a model vehicle configuration, and which are used as a promotional device to hold food or other items of interest to the user and also provide an advertising medium or display for the enjoyment and amusement of the user.

BACKGROUND OF THE INVENTION

Disposable cardboard trays and cartons for holding food items have been used by restaurants and theaters as a convenience for their customers and in particular, to organize and hold food for children and create additional interest by designs that are displayed on the tray or carton. When intended as a promotional device, it is desirable for a cardboard model to be easily and quickly constructed preferably from a die cut cardboard sheet by folding various panels and tabs along score lines in the material into an assembled shape. Particularly with respect to young children, printed material on the carton adds to the child's interest. Furthermore, as the carton organizes food items together, it minimizes the volume of separate pieces of trash that must ultimately be disposed of by the provider. Advantages of a one sheet, i.e., one-piece unit, include factors such as lower cost, easier printing of the model design or artwork on the cardboard, compact shipping, and ease and quickness in construction; however, the one-piece system can also make it very difficult to realistically replicate the contours and features of certain designated objects, such as modern cars.

BRIEF DESCRIPTION OF THE INVENTION

In an embodiment of the present invention a method of forming a container for food or other items having a model vehicle configuration is provided by an elongated, cardboard-like sheet having a first end portion that presents the cabin, rear deck and tail of the vehicle, a central portion that presents the bottom and sides of the vehicle and a second end portion that presents the hood and front windshield of the vehicle, with the first end portion including a pair of substantially parallel longitudinal fold lines defining left and right side segments of the vehicle and having a first pair of substantially parallel transverse fold lines between the first end portion and the central portion and a second pair of substantially parallel transverse fold lines between the second end portion and the central portion. The first end portion is folded along the first pair of transverse fold lines and secured in a position to present an open cabin, rear deck and tail of the vehicle, whereby the open cabin may provide the container for food and other items. The central portion is folded upwardly along the pair of longitudinal fold lines to present the sides of the vehicle, and the second end portion is folded along the second pair of transverse fold lines and secured in a position to present the hood and front windshield of the vehicle.

Other advantages of this carton assembly and method of making the same will become apparent from the following description taken in connection with the accompanying drawings, wherein is set forth by way of illustration and example an embodiment of the present invention.

DETAILED DESCRIPTION

Figure 6:
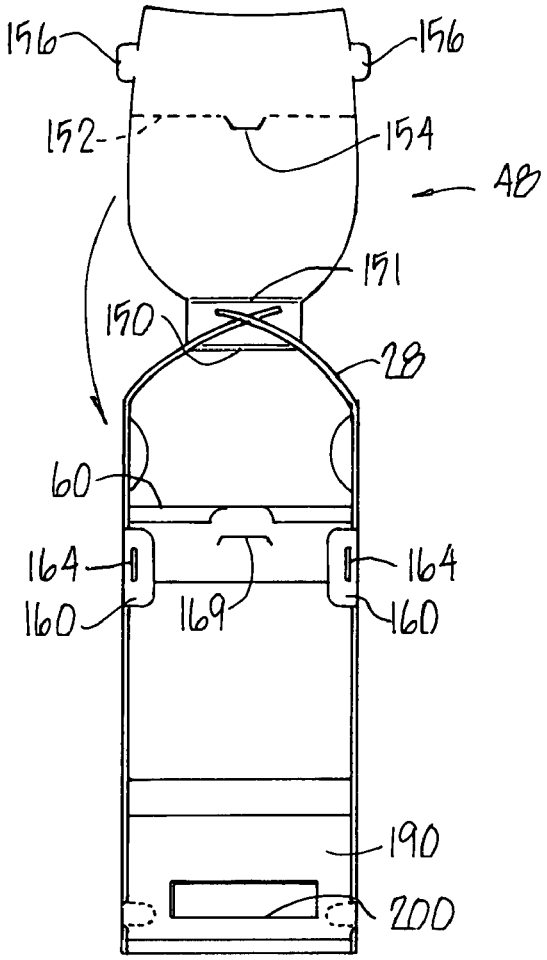
FIGS. 5 and 6 are sequential views showing the additional stages of the assembly of the carton or tray.
Figure 7:
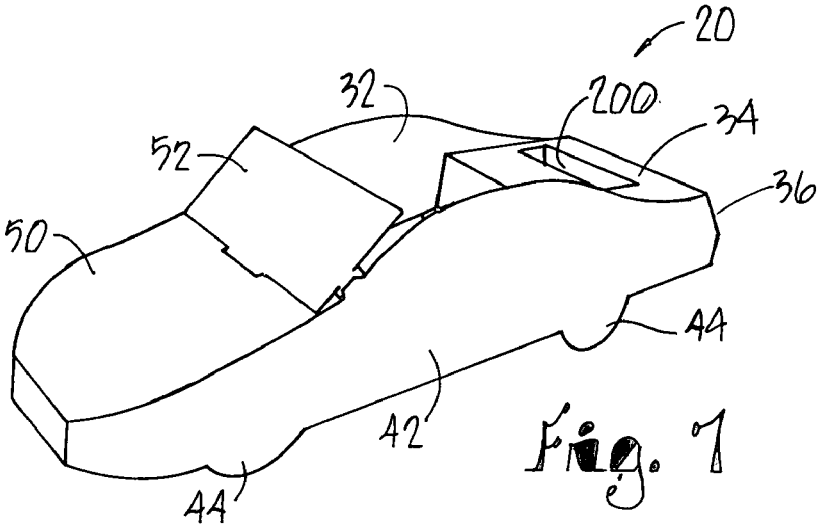
FIG. 7 is a side perspective view of the sheet of FIG. 1 formed into a food carton in the form of a NASCAR stock race car.

Referring initially to FIGS. 1-7, a sequence of steps is illustrated and shows a flat piece of sheet material 10 (FIG. 1) which, after the assembly operation is complete, becomes an assembled carton or tray 20 (FIG. 7). As shown and described herein, the carton 20 takes the form of a NASCAR stock racing car but could take any desired form. The sheet 10 is paperboard or a similar semi-rigid material capable of retaining fold lines and die cut so that tabs and openings are formed upon removal of the cutout portions. A suitable material is 18-point white C 1S SBS stock or a thin plastic material capable of retaining fold lines and being folded to a desired configuration. As is evident from FIG. 1, in its initially unassembled state, the sheet 10 is planar, flat and elongated and has a first or rear end 12 and a second or front end 14.

Figure 1:
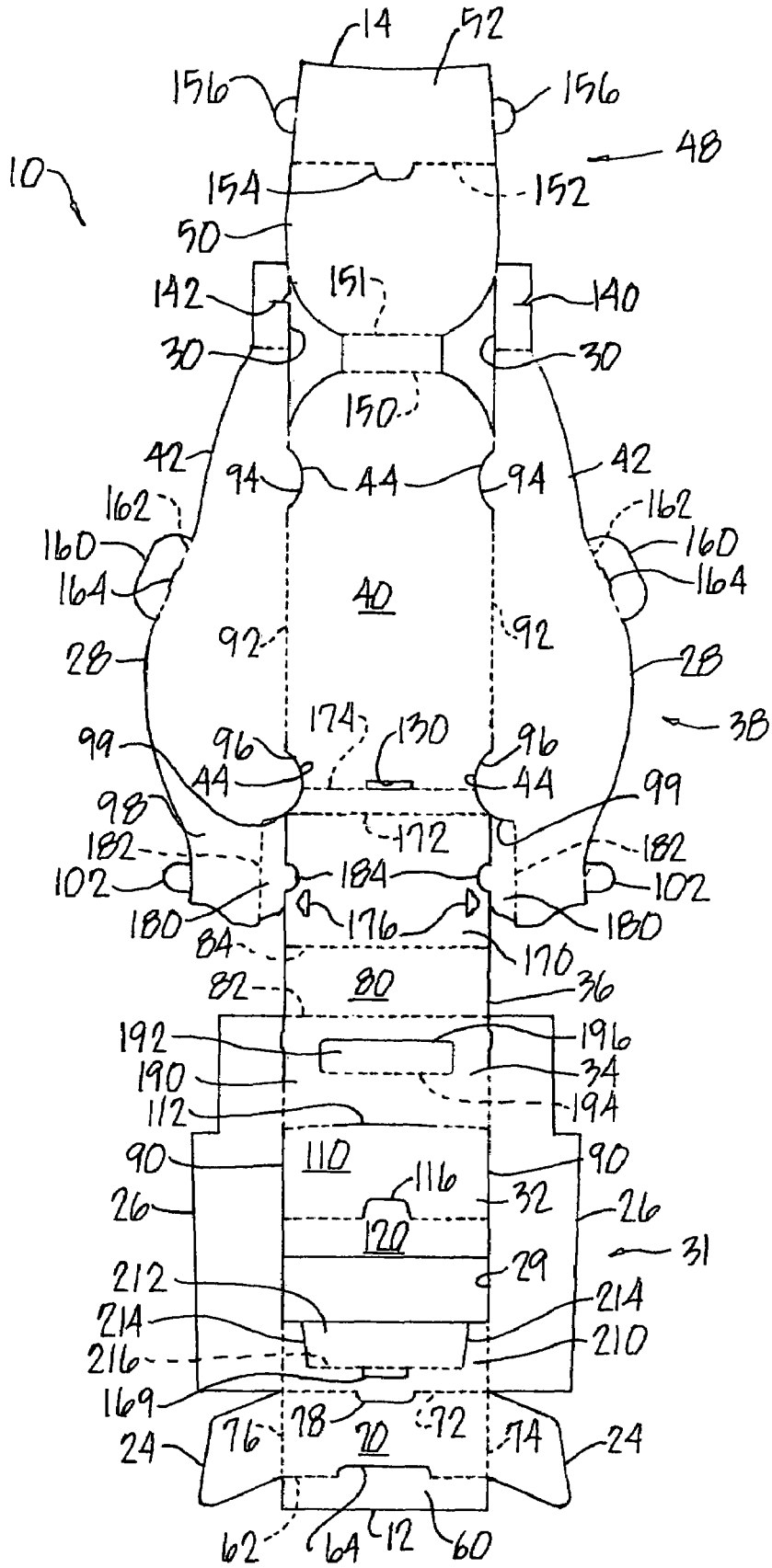
FIG. 1 is a top plan view of a piece of flat sheet material having fold and perforation lines thereon, from which a carton or tray is formed in accordance with the present invention.

FIG. 1 shows that the sheet 10 has a number of fold lines and perforation lines therein, the purpose of which will be described below. Additionally, the sheet stock from which the carton or tray 20 is formed is die cut to provide the perimeter configuration shown, which is essentially an elongated rectangle with three pairs of opposed, transversely projecting flaps 24, 26 and 28, cut-out 29, and a pair of mirror image cut-outs 30. The first and second pairs of flaps 24 and 26 extend from the sheet's first or rear end portion 31. Upon assembly, the rear portion 31 presents the cabin 32, rear deck 34 and tail 36 of the race car carton 20. The third pair of flaps 28 extend from the central or body portion 38 of the sheet 10 to present the bottom 40, sides 42 and wheels 44 of the assembled race car carton 20. The second or front end portion 48 extends from the body portion 38 and presents the hood 50 and front windshield 52 of the race car carton 20 upon assembly. The mirror image cut-outs 30 generally define the junction between the body portion 38 and the front end portion 48.

The rear portion 31 includes an end flap 60 extending from the rear end 12 of the sheet 10 to a transversely extending fold line 62. The fold line 62 extends between the rearward-most ends of flaps 24. At the center of the fold line 62 is a cut out tab 64.

A cabin panel 70 extends from the fold line 62 at one end to the fold line 72 at the other end and fold lines 74 and 76 along its sides. The fold line 72 extends transversely across the sheet 10 in alignment with the rearward-most ends of the flaps 26, parallel to the fold line 62 and includes a central cut out tab 78.

The fold lines 74 and 76 extend longitudinally to form the junction between the flaps 24 and the panel 70.

An end tail panel 80 is defined by a pair of parallel fold lines 82 and 84 extending transversely across the sheet 10. The fold line 82 extends in alignment the central-most ends of the flaps 26.

Figure 2:
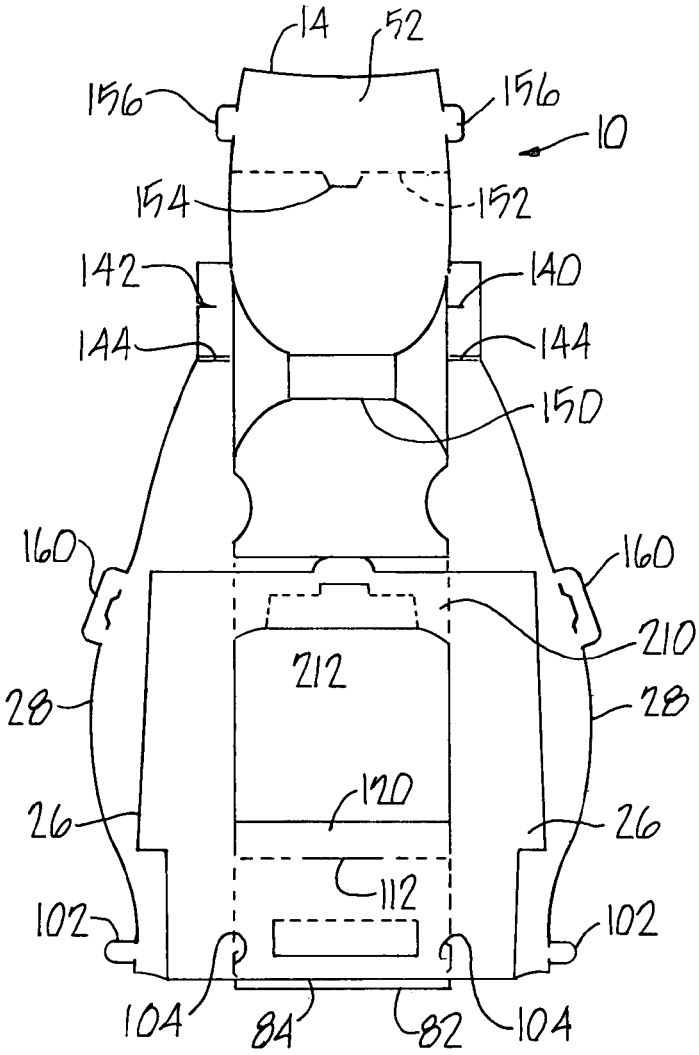
FIG. 2 is a top view of the sheet material of FIG. 1, with the first end folded over and secured to the central portion thereof.
Figure 3:
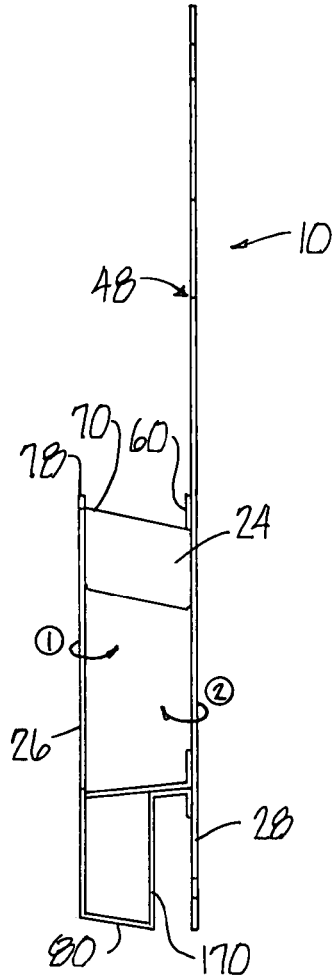
FIG. 3 is a right side view of the sheet, showing the central portion's flaps folded inwardly.

As shown in FIGS. 2 and 3, an initial fold is made at the fold line 82. The end flap 60 is secured to the body portion 38 of the sheet 10 preferably with suitable glue or other adhesive so that the sheet 10 remains substantially flat and planar. The cabin panel 70 is folded forward along the fold lines 62 and 72, and the flaps 24 are folded inwardly and rearwardly along the fold lines 74 and 76. This causes the tail panel 80 to also stand upright along the fold lines 82 and 84. The cabin panel 70 has a height greater than that of the end tail panel 80.

The flaps 26 include a pair of parallel longitudinal fold lines 90. The flaps 28 also include a second pair of parallel fold lines 92 which extend longitudinally except at the front and rear tire defining areas 94 and 96, where they curve. The tire defining areas 94 and 96 and the rearward ends 98 of the flaps 28 are cut so that these portions of the flaps 28 may be separated or pulled free from the sheet 10. Another cut line 99 extends where the rearward ends 98 meet the rear tire areas 96.

Figure 4:
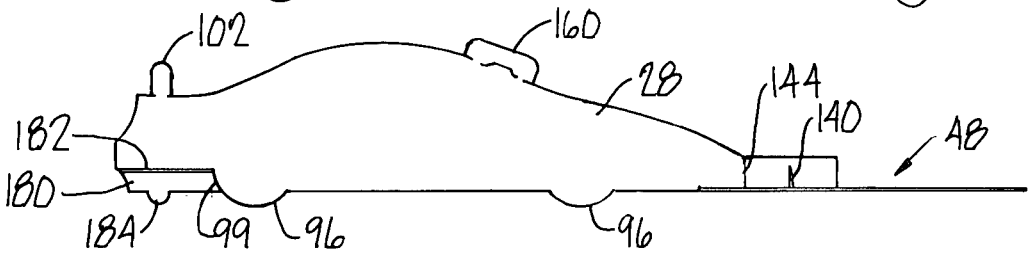
FIG. 4 is a right side view of the cardboard-like sheet as in FIG. 3, showing the right side of the carton or tray folded into position.

As shown in FIG. 3 by arrow 1, the flaps 26 are folded downwardly along the fold lines 90, and then by arrow 2, the flaps 28 are folded upwardly along the fold lines 92. The rearward ends 98 of the flaps 28 are pulled outwardly to separate them from the sheet 10. The result is shown in FIG. 4, where it can be appreciated that a portion of the tires now extend substantially perpendicularly from the sheet 10.

Figure 5:
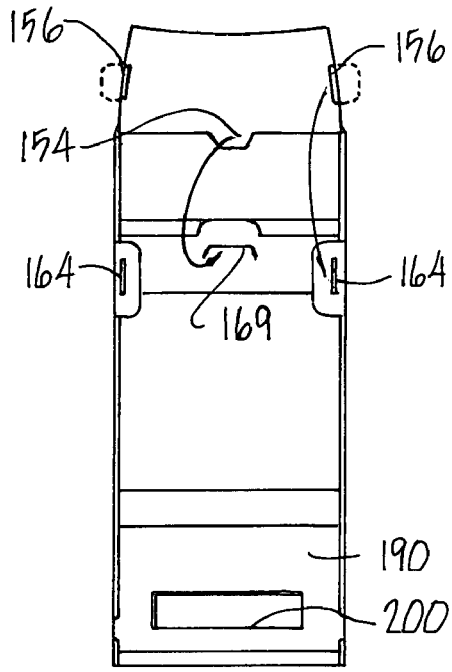

Next, the tabs 102 that extend upwardly from the rear end of the flaps 28 are inserted into the corresponding slits 104 formed in the fold lines 90, as shown in FIG. 5.

The rear portion 31 further includes a second cabin panel 110 which extends between transversely extending fold line 112 and the cut-out 29. Its sides are cut along the fold line 90 of the flaps 26. The cabin panel 110 has an end flap 120 formed by fold line 114. The end flap 120 includes a tab 116 extending from the center of the fold line 114. Except at the tab, the fold line 116 extends transversely and parallel to the fold line 112.

Figure 8:
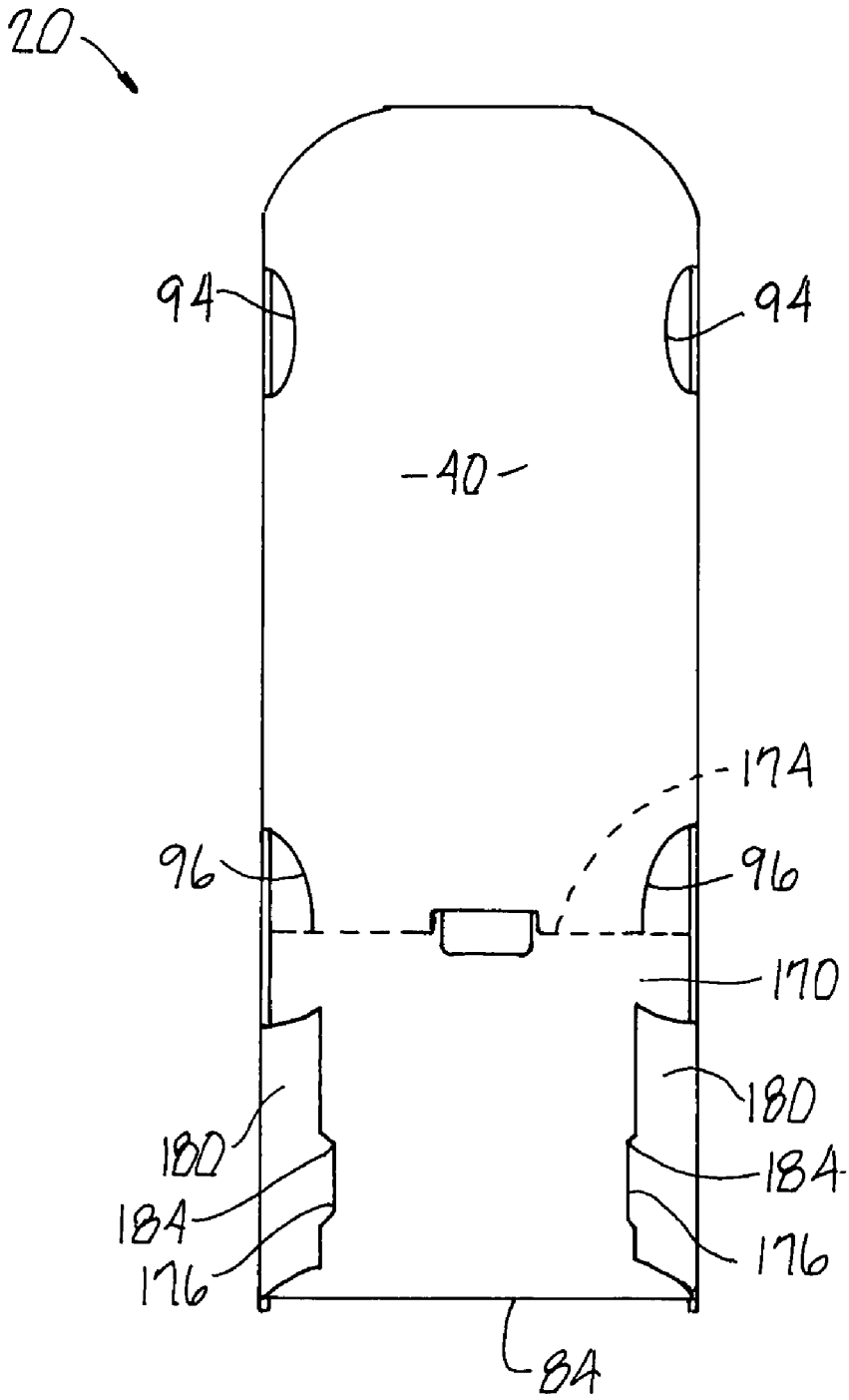
FIG. 8 is a bottom plan view of the racecar of FIG. 7.

Now, formation of the cabin 32 is completed as best shown in FIGS. 2 and 8. The second cabin panel 110 is folded downwardly along the fold line 112, and the end flap 120 is folded outwardly freeing the tab 116 which is then inserted into the corresponding slot 130 formed in the central portion 38 of the sheet 10 between the rear tire areas 96.

The side panels 28 include slits 140 and 142 cut partially therethrough and fold lines 144 at the front end thereof. The slit 140 in right side panel 28 extends from the panel's lower edge, and the slit 142 in the left side panel extends from the panel's upper edge.

The front ends of the panels 28 are bent inwardly. The slits 140 and 142 receive one another securing the front ends of the panels 28 together to form the front of the car, as in FIG. 5.

The front portion 48 includes a pair of transversely extending fold lines 150 and 151 which join the front portion 48 to the central portion 38 of the sheet 10. The front portion 48 further includes a transversely extending fold line 152 having a tab 154 formed at the center thereof. Finally, a pair of parallel tabs 156 extends outwardly from opposite sides of the front portion 48 substantially adjacent the front end 14 of the sheet 10.

Next in assembly, as shown by the arrow in FIG. 5, the front portion 48 is folded at fold lines 150 and 151 upwardly and backwardly. As shown in FIG. 6, the front portion 48 is also folded forwardly along the fold line 152, and as shown by an arrow, the tab 154 is inserted into the slot 169.

Tabs 160 extending upwardly from the side panels 28 are folded inwardly along their fold lines 162. As shown by an arrow in FIG. 6, the tabs 156 of the front portion 48 are inserted into the slits 164 formed in the fold lines 162 of the tabs 160 to secure the front portion 48 to the central portion 38 of the sheet 10.

The body portion 38 of the sheet includes bottom tail panel 170 (FIG. 8) which extends from the fold line 84 of the end tail panel 80 to the carton bottom 40. The bottom tail panel 170 and the carton bottom 40 are separated by a pair of parallel and transversely extending fold lines 172 and 174. One edge of the slot 130 forms the central portion of the fold line 174. The bottom tail panel 170 includes aligned cut-outs 176.

The rearward ends 98 of the flaps 28 present panels 180 defined by the cut line 99, the ends of the fold lines 92 and a fold line 182. These ends 98 include tabs 184 that extend into the bottom tail panel 170 before assembly.

Next, the carton's tail 36 is formed in assembly. As best seem in FIG. 8, the bottom tail panel 170 is pushed upwardly and forward along the fold lines 172 and 174, and the panels 180 are folded along the fold lines 182. The tabs 184 are inserted into their corresponding cut-outs 176. The rearward ends 98 have previously been pulled out and separated from the sheet 10.

Lastly, the sheet 10 includes top tail panel 190. As in FIG. 1, The top tail panel 190 has a flap 192 defined on one end by a fold line 194 and on its other three sides by a cut line 196.

As seen in FIGS. 5 and 6, a compartment 200 is now formed by pushing downwardly on the flap 192 so that the flap 192 separates from the top tail panel 190 along the three sides having the cut line 196 and folds inwardly along the fold line 194.

As shown in FIG. 7, the race car carton 20 is now assembled and ready to receive food or other items in either the cabin area 32 or the compartment 200. The cabin area 32 may be enlarged if necessary.

The sheet 10 includes another panel 210 between the cut-out 29 and cabin panel 70 (FIG. 1). This panel 210 includes a flap 212 defined on its sides by perforation lines 214 and its end by a fold line 216. The slot 169 is positioned at the center of the fold line 216.

If needed, the flap 212 is folded upwardly along its side perforations 214 and along the fold line 216 to enlarge the cabin area 32. If this is done, the tabs 156 are disconnected from within slits 164.

Figure 9:
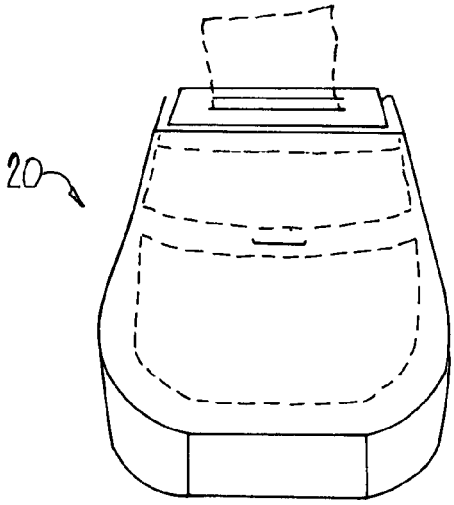
FIG. 9 is a front perspective of the racecar of FIG. 7, showing the detail and contours of the hood and front windshield of the racecar in phantom as well as a package of candy, for example, in the rear compartment.
Figure 10:
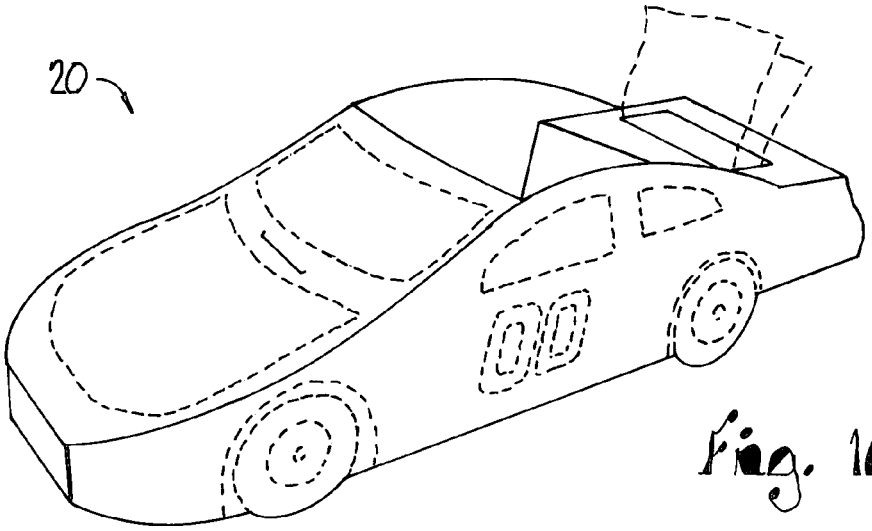
FIG. 10 is a side perspective of the racecar of FIG. 7, showing the detail and contours thereof in phantom.
Figure 11:
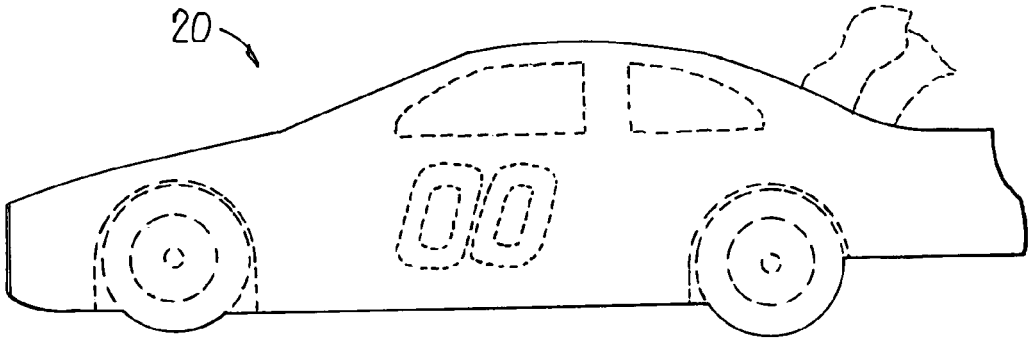
FIG. 11 is a side view of the racecar of FIG. 7 further showing detailing and contours thereof.

FIGS. 9-11 illustrates a carton 20 with detailing printed on the sheet 10 shown in phantom which makes the carton 20 more appealing, especially for children. A food item is also shown in phantom inserted into the compartment 200 in phantom. As shown and described herein, the carton 20 is printed to depict a NASCAR stock racing car. The method of folding the carton allows contours, such as curves and angles, to be accurately reflected to enhance the carton's appeal.

Having thus described the invention, what is claimed as new and desired to by secured by Letters Patent is as follows:

1. A method of forming a container for food or other items having a model vehicle configuration, said method comprising:

(a) providing an elongated sheet of semi-rigid material having a first end portion that defines an open cabin, rear deck and tail of the vehicle, a central portion that presents the bottom and sides of the vehicle and includes a first set of transversely spaced, longitudinal fold lines defining left and right sides of the vehicle, a second end portion that presents the hood and front windshield of the vehicle, a first set of spaced transverse fold lines between the first end portion and the central portion and a second set of spaced transverse fold lines between the second end portion and the central portion, (b) folding said first end portion along the first set of transverse fold lines and securing it in a position to present said open cabin, rear deck and tail of the vehicle, whereby the open cabin may provide the container for food and other items, (c) folding said central portion upwardly along the first set of longitudinal fold lines to present the sides of the vehicle, and (d) folding the second end portion along the second set of transverse fold lines and securing it in a position to present the hood and front windshield of the vehicle.

2. The method as claimed in claim 1, wherein said step (a) includes providing said first end portion with a plurality of flaps and step (b) includes folding said flaps along a second set of transversely spaced, longitudinal fold lines.

3. The method as claimed in claim 1, wherein said step (a) includes providing the central portion with a set of opposed side flaps presenting the left and right sides, and said step (c) includes folding the side flaps upwardly along the first set of longitudinal fold lines to present the sides of the vehicle.

4. The method as claimed in claim 3, wherein said step (c) includes bending the ends of the side flaps and securing them together.

5. A container for food or other items having a model vehicle configuration, comprising:

an elongated sheet of semi-rigid material having a first end portion that defines an open cabin, rear deck and tail of the vehicle, a central portion that presents the bottom and sides of the vehicle and includes a first set of transversely spaced, longitudinal fold lines defining left and right sides of the vehicle, a second end portion that presents the hood and front windshield of the vehicle, a first set of spaced transverse fold lines between said first end portion and said central portion and a second set of spaced transverse fold lines between said second end portion and said central portion;

said first end portion being folded along said first set of transverse fold lines and secured in a position to present said cabin, rear deck and tail of the vehicle, whereby the open cabin or rear deck may provide the container for food and other items;

said central portion being folded upwardly along said set of longitudinal fold lines to present the sides of the vehicle; and said second end portion being folded along said second set of transverse fold lines and secured in a position to present the hood and front windshield of the vehicle.

6. A container as claimed in claim 5 wherein said first end portion has a plurality of flaps that fold along a second set of transversely spaced, longitudinal fold lines.

7. A container as claimed in claim 5 wherein said central portion has a set of opposed side flaps that fold upwardly along said first set of longitudinal fold lines to present the sides of the vehicle.

* * * * *